US005887515A

United States Patent [19]

Kunstmann et al.

[11] Patent Number: 5,887,515

[45] Date of Patent: Mar. 30, 1999

[54] METHOD FOR THE CONTINUOUS PRODUCTION OF A MAT FOR THE MANUFACTURE OF BOARDS OF WOOD MATERIAL OR THE LIKE

[75] Inventors: Uwe Kunstmann, Rossdorf; Michael Diefenbach, Darmstadt, both of Germany

[73] Assignee: Dieffenbacher Schenck Panel Production Systems GmbH, Bensheim, Germany

[21] Appl. No.: 833,464

[22] Filed: Apr. 7, 1997

[30] Foreign Application Priority Data

Apr. 11, 1996 [EP] European Pat. Off. ..... 96105712

[51] Int. Cl.[6] ..... B30B 15/30

[52] U.S. Cl. ..... 100/39; 100/35; 100/96; 100/152; 209/667; 264/113; 425/83.1

[58] Field of Search ..... 100/35, 39, 41, 100/45, 96, 152; 198/597, 598, 633; 209/667, 671, 673; 425/83.1; 264/113

[56] References Cited

U.S. PATENT DOCUMENTS 1,498,144 6/1924 Avery ..... 209/667
1,641,777 9/1927 Newhouse .
1,647,816 11/1927 Riddell .
1,899,292 2/1933 Rienks .
2,370,539 2/1945 Hodecker .
2,588,309 3/1952 Troyer ..... 209/667

(List continued on next page.)

OTHER PUBLICATIONS

Ronald G. Frashour, The Columbia Microfelter, *Particle Board*, pp. 319–325, Mar. 1967.

*Primary Examiner*—Stephen F. Gerrity
*Attorney, Agent, or Firm*—Fulbright & Jaworski LLP

[57] ABSTRACT

In a method for the continuous production of a running mat (6) of stocked particles (2) of different dimensions by the use of a conveyor spreading method, for the production of wood material boards or similar boards by subsequent pressing of the mat, for the solution of the problem of having a well-defined supporting plane for the spread material independently of the rotary speed of the spreading rolls, it is proposed that, during the conveyor spreading action (11), at first holdouts be formed deliberately and continuously over the entire spreading width and the entire spreading length of the conveyor spreading mechanism, out of which individual spreading is done for the continuous formation of the advancing mat (6); at the same time an apparatus is proposed for the practice of the method for the performance of the already-named tasks.

19 Claims, 3 Drawing Sheets

U.S. PATENT DOCUMENTS

| | | | |
|---|---|---|---|
| 2,786,574 | 3/1957 | Clark . | |
| 2,912,723 | 11/1959 | Roberts . | |
| 3,117,671 | 1/1964 | Pearce et al. . | |
| 3,719,290 | 3/1973 | Voigtlaender . | |
| 3,817,375 | 6/1974 | Herks . | |
| 3,836,016 | 9/1974 | Saufhaus . | |
| 3,848,741 | 11/1974 | Haley et al. . | |
| 3,864,066 | 2/1975 | Gerhardt . | |
| 3,949,862 | 4/1976 | Voigtlaender . | |
| 4,025,254 | 5/1977 | Arnold . | |
| 4,063,858 | 12/1977 | Axer et al. . | |
| 4,102,502 | 7/1978 | Vaplon et al. . | |
| 4,209,097 | 6/1980 | Nordmark et al. . | |
| 4,247,497 | 1/1981 | Wolf . | |
| 4,315,722 | 2/1982 | Ufermann | 425/83.1 |
| 4,362,452 | 12/1982 | Sparr . | |
| 4,377,230 | 3/1983 | Burkner . | |
| 4,380,285 | 4/1983 | Burkner et al. . | |
| 4,389,175 | 6/1983 | Sakschek . | |
| 4,405,277 | 9/1983 | Burkner et al. . | |
| 4,452,694 | 6/1984 | Christensen et al. . | |
| 4,470,741 | 9/1984 | Bossler et al. . | |
| 4,504,207 | 3/1985 | Arnold . | |
| 4,557,882 | 12/1985 | Arnold . | |
| 4,600,106 | 7/1986 | Minardi . | |
| 4,623,058 | 11/1986 | Bissler . | |
| 4,666,029 | 5/1987 | Burkner . | |
| 4,703,783 | 11/1987 | Buksek . | |
| 4,852,718 | 8/1989 | Kunstmann . | |
| 4,865,798 | 9/1989 | Henschel et al. . | |
| 4,903,845 | 2/1990 | Artiano . | |
| 5,012,933 | 5/1991 | Artiano . | |
| 5,078,274 | 1/1992 | Brown . | |
| 5,232,097 | 8/1993 | Tohkala | 209/673 |
| 5,386,914 | 2/1995 | Eramaja et al. | 209/673 |
| 5,496,570 | 3/1996 | Mauss et al. | 425/83.1 |

METHOD FOR THE CONTINUOUS PRODUCTION OF A MAT FOR THE MANUFACTURE OF BOARDS OF WOOD MATERIAL OR THE LIKE

BACKGROUND AND SUMMARY OF THE INVENTION

The invention relates to a method for the continuous production of a moving mat from a stock of particles of different dimensions by means of a conveyor spreading mechanism for the manufacture of wood boards or the like by means of subsequent pressing of the mat.

By the disclosure in U.S. Pat. No. 5,012,933 a method and an apparatus for the segregation of excessively thick wood material has been made known, in which material that did not pass in the grading process was segregated by means of grading cylinders, and then was returned again to the grading process after regrinding. A grading of the material was achieved by the fact that, in a first step, a cylinder grader was used, in which the cylinders are at distance apart which increases in the direction of conveyor movement, and the material of excessively great size was discharged at the end of the first set of cylinders, while the remainder, still containing particles of the correct size and smaller, was graded in a second step to remove the fines. At the end of the cylinder train the oversize pieces were fed directly to grinders to be reground.

In a second grading process, which took place below the first grader, a separation was made again between fine material and usable material; the fines in this stage were dumped by the cylinder grader into a hopper, while the material needed for the manufacture of paper was delivered to another hopper for further processing. With a grading procedure of this kind, no mat such as can be used for the production of wood boards or the like can be built up by means of the conveyor spreading mechanism disclosed.

In German Auslegeschrift 1205274 an apparatus has been disclosed in which throw-scattered wood chips or other such spreadable particles are formed on a strand support (shaping band) into a strand which is fed continuously or in sections into a press which makes them into solid products, especially flake boards in which the particles are randomly oriented. Then, on the way from the throwing point to the strand support either one or more spring frames or one or more special throw cylinders, or one or more vortex blowers, or a combination of these or other apparatus producing the same effect, the particles coming from the throwing point have to pass by them for orientation in substantially different directions. With an apparatus of this kind it is difficult to produce a mat for the production of wood or other such boards in which wrong-size particles must not be carried into the mat. Attempts have also been made to achieve an improvement by rotary speed variations, in order to remedy such deficiencies. These attempts, however, fail.

Setting out from here, the present invention is addressed to the problem of having a well-defined throw-down plane for the particle material independently of the speed of the scatter cylinders, so that not only will no wrong particles enter the spread, but also a build-up of the particles passing through the rolls will be achieved, that will be uniform over the entire field. The definition of a space between the scatter plane and the mat plane will furthermore counteract a faulty spread.

This problem is solved by the present invention in that, during the conveyor spreading, holdout pockets are first created deliberately and continually over the entire width and length of the conveyor spreading mechanism, and from them individual spreading actions are performed for the continuous formation of the advancing mat. This brings it about that, for one thing, both the space between the starting point of the scatter and the deposition of the spread material in the mat are very well defined, and that, on the other hand, a virtually equal amount of the particle stream being spread is discharged throughout the scattering procedure.

For the embodiment of this inventive method, it is proposed that the intentional formation of the holdouts over the spread length of the conveyor spreading mechanism be made controllable. Thus it is possible, for example, in the case of a section-by-section pressing of a mat to wood flake boards, to control the density and thus the strength of the board in the lengthwise direction.

An embodiment of the inventive method consists in the fact that the intentional formation of the holdouts over the spreading width of conveyor spreading mechanism is controllable. By such control the density and thus the strength also transversely of the finished flake board can be influenced, so that in the end effect a wood material board can be produced in which predetermined strength properties can be produced both lengthwise and transversely.

In still another embodiment of the inventive method, particles unsuitable for the conveyor spreading mechanism are carried away by a conveyor separately from the conveyor spreading mechanism. By this conveyor process a definite separation of the material is achieved, which is necessary in order to produce boards of predetermined properties, and which at the same time offers the possibility for reusing the segregated material either by returning it into the spreading procedure, or in case the material is not usable, for example when glue lumps occur, of separating this material before it becomes embedded in the board, as it is claimed in the inventive characteristic of claim 4.

In a preferred embodiment the rejected particles are fed to a re-grinding apparatus, at the end of which usable particles are recycled, and unusable particles are separated out. In this way a reduction of waste is achieved, and the recycling of such material is made possible, for example in the use of wood which has a very slight thickness, yet in other dimensions has a considerable surface area.

In still another embodiment of the method, depending on the particles to be spread, and depending on how the advancing mat is formed by conveyor spreading, a predetermined separation of the particles is accomplished. Merely by means of the predetermined separation of the particles based on the particle stream and the throughput of the conveyor spreading mechanism, it is possible to produce predetermined cross-sectional patterns through the thickness of the mat.

Setting out from an apparatus with a bunker for spreading particles which discharges to an adjoining spreading station whose width corresponds to the width of the mat and has a series of revolving spreading rolls disposed in the spreading station and provided with a texture, plus a support continuously moving under the spreading station for receiving a spread flake mat that is to be pressed for the production of wood or similar boards, it is proposed that the circumferential surfaces of each spreading roll have first equally long, channel-like pockets in a plurality of rows alternating in the circumferential direction, and offset therefrom a plurality of rows with second, equally long, channel-like pockets, that each row of the channel-like pockets be separated from the next row by lands on the circumferential surface, and that the first and second equally long, channel-like pockets in the axial direction of each spreading roll be separated by lands over the entire length of the circumferential surface of the spreading roll, so that each channel-like pocket constitutes a separate indentation in the circumferential surface. With this apparatus according to the invention, predetermined amounts of the particles issuing from the bunkers can be formed, and at the same time cause, by the rotation of the series of spreading rolls, a transport by which also the other, distinct indentations in the spreading rolls are filled simultaneously, so that, upon the continued rotation of the spreading rolls a conveyor spreading mechanism results, in which substantially equal amounts of spread material can be let out of the rotating spreading rolls at the same time and be deposited on the continuously advancing support.

As an embodiment of the apparatus of the invention each spreading roll bears second equally long channel-like pockets at an angle to its axis, that offset therefrom several rows are provided with second, equally long channel-like pockets whose channel axes are at an angle to the slanted channel axes of the first equally long channel-like pockets. By the arrangement of equally long channel-like pockets at an angle to one another, but which do not run through one another, it is brought about according to the invention that, especially in the case of rotating spreading rolls that are directly in contact with one another at their surfaces, any pinching or jamming of chip material before it reaches the channel-like recesses is prevented, and also that the transport through the entire array of revolving spreading rolls disposed in tandem operates faultlessly. Thus a still further improved holdover in the channel-like pockets is achieved, which then, as the spreading rolls continue to rotate, permits a precise distribution from these holdover pits onto the support running along thereunder.

In a preferred embodiment of the invention the angle between the first and second equally long channel-like pockets is greater than 0 degrees and less than 180 degrees. Thus, in the case of a plurality of tandem rotating spreading rolls configured according to the invention, a row of pocket-like pits which are closed off from the particles dropping from above, i.e., from the bunker, in the area of contact of the circumferential surfaces, by lands running in the direction of the longitudinal axis of the spreading rolls and in the direction of the circumference of the spreading rolls. The slanting of the spreading pits at the angle specified by the invention, facilitates the filling of the pits.

In yet another embodiment of the apparatus according to the invention, the channel-like pockets have semicircular curves at their extremities on the circumference of the roll. The semicircular curve facilitates the intertwining of particles during the filling and emptying of the channel-like pockets.

In yet another embodiment of the apparatus according to the invention, the channel-like pockets are rounded off from the circumference of the roll to the bottom of the channel, perpendicular to the direction of the channel axis. This configuration of the channel also promotes both the filling and the emptying of the channel-like pockets; it serves also to facilitate a squeezing of the particles being fed through the cylinders against the adjacent rolls of the conveyor spreading apparatus which produces the conveyor spreading mechanism.

In another embodiment of the channel-like pockets according to the invention the channel-like pockets have rounded cross sections. This embodiment of the invention contributes to keeping the channel-like pockets clean.

In a preferred embodiment, the apparatus of the invention is characterized in that each spreading roll consists of two cylinder sleeves arranged in tandem along the axis and having channel-like pockets of equal length, and in that the lands between them are continuous over the entire length of the spreading roll. By making the spreading rolls from sleeves, in the first place a considerable saving of weight is achieved in comparison with solid rolls based the same outside diameter, and in the production of the surface of the roll considerable savings are achieved by the fact that any desired spreading roll lengths can be made up of individual roll sleeve units in the manner of a modular system, without the need to invest in more tooling for the manufacture of exceedingly long and slender spreading rolls. Also, dividing the total length of the spreading rolls into sleeve units of different lengths counteracts the flexure of a spreading roll made up of sleeves.

In further development of the apparatus visible circumferential abutting edges occurring between at least two tandem spreading roll sleeves are not in alignment with one another. This brings it about that no harmful effects will be propagated from the abutting edges through the entire series of the rotating spreading rolls.

In a preferred embodiment visible abutting edges occurring between the sleeves run spirally over the circumferential surface of the single spreading roll. This embodiment also serves to prevent any sources of error that might be created by the abutting edges.

In a preferred embodiment, there are provided of two sleeves an abutting edge between the sleeves is disposed away from the center between the two sleeve surfaces. This constitutes an especially preferred embodiment of the invention for the prevention of the sagging of spreading rolls in sleeve form.

In regard to the configuration of the channel-like pockets, the distance (depth) between the spreading roll's circumferential surface and the bottom of the channel-like pockets differs from roll to roll. This makes it possible to hold out additional material in the channel-like pockets of the downstream and upstream pairs of spreading rolls through the transport section, i.e., during the conveyor spreading action. Thus on the one hand the throughput in such conveyor spreading mechanisms is increased while the quality of the spreading remains the same, and on the other hand any influence on the spreading quality is avoided.

In a preferred embodiment of the apparatus the distance (depth) between the circumferential surface of the spreading roll and the bottom of the channel-like pockets differs over the length of the length of the individual spreading roll. By this arr transversely of the direction of the advance of the mat in formation, which is then processed to wood or other such boards, serves to produce a greater density in the marginal area of these wood material boards, which can be of advantage in the case of a spline-and-groove design of such boards.

In a preferred embodiment of the apparatus it is proposed that the uninterrupted lands on the surface of the spreading roll terminate in cutting edges. Thus, the particle throughput can be increased considerably, no pinching of the particles occurs, and furthermore a well-defined discharge from the pockets takes place uniformly.

In another embodiment of the present invention, the rolling process, the pressure-casting or injection molding process is used in the preparation of the surfaces of the spreading rolls according to the method for the continuous production of a mat according to the present invention.

In a preferred embodiment, spreading rolls made according to the invention are characterized in that their circumferential surface is then subjected to a machining procedure. The machining of the circumferential surface makes it possible for the first time for spreading rolls designed for a conveyor spreading system to provide for the positive and smooth control of the particle stream needed for the spreading, even in the case of direct contact of their circumferential surface.

Therefore, it is possible for the first time, by means of the sets of spreading rolls with a smooth but indented surface to form continuously a well-defined mat from a stream consisting of particles of different dimensions, wherein, depending upon the direction of movement of the support for receiving the mat and/or the arrangement of the spreading rolls according to the invention disposed in tandem and performing the conveyor spreading mechanism, to produce a mat on the support, the cross section of which is continuously formed beginning from a topmost layer with fine particles, then a layer with coarser or coarse particles, and thereafter, again with fine particles, the other outside layer of the mat.

It can, of course, be understood that a mat thus made can be used by itself, or parts of it, for the facing of other mats in order to produce therefrom wood or similar boards by pressing.

The invention will be further explained in the following description of embodiments thereof.

DETAILED DESCRIPTION

In the following description the same components in the various figures are identified by the same reference numbers.

Figure 1:
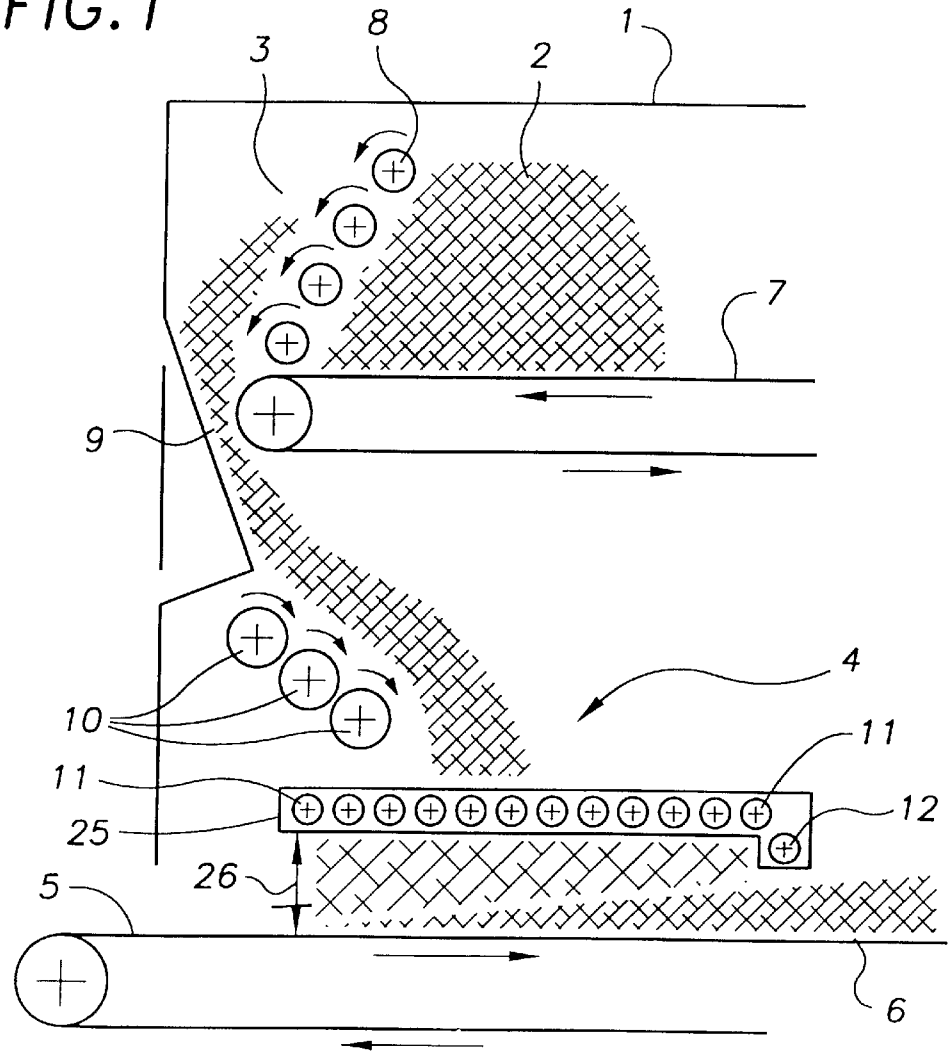
FIG. 1 represents a system for the production of a divided mat by the method of the invention.

In FIG. 1, particles 2 stored in a bunker 1 are fed through an opening 3 to a spreading station 4 whose width corresponds to the width of a moving support 5 on which a flake mat 6 is produced, which is then pressed continuously or discontinuously to form boards of wood material at a pressing station not shown.

By the movement of a conveyor belt 7 in the direction of the arrow the stored particles 2 are first moved against the feed rolls 8 of bunker 1 which are also moving in the direction of the arrow, and thus particles are taken from the bunker and are fed down a chute 9 to preliminary fluffing rolls 10.

The preliminary fluffing rolls are already in the spreading station and distribute the particles along the length of the spreading station 4 by their rotation in the direction of the arrow.

Underneath the preliminary fluffing rolls 10 a row of spreading rolls 11 is shown, of which only the first and the last of the spreading rolls has been given the reference number 11. In this embodiment the remaining ten rolls 11, which rotate clockwise the same as the first and last spreading rolls 11, have not been given numbers for the sake of simplicity. At the end of this series of spreading rolls 11, which likewise reach across the entire width of the moving support 5 there is a return screw conveyor 12 which serves to catch particles which, due to their size, could not pass through the spreading rolls 11 during the spreading procedure and return them to the bunker 1 through appropriate carriers, or remove from the spreading procedure defective material, such as lumps of glue, which is then discarded through the return screw conveyor 12.

In the embodiment, all twelve of the spreading rolls 11 rotate in the same sense, i.e., clockwise. It is also possible, however, for the spreading rolls 11 to rotate all in the opposite direction. For this purpose it is then necessary that the return screw conveyor 12 to be disposed at the other end of the spreading rolls 11 in order to prevent defective material from falling onto the support 5 for forming the mat 6 and thus have a negative effect on the outermost layer of the mat.

It is also conceivable for the rolls 11 to have each a different speed, for the purpose, for one thing, of accelerating the movement of the particle stream so as to achieve a higher throughput through the spreading rolls 11 or, in the case of a reduction of the speed of individual rolls, with a lower output of particles 2 by the spreading rolls 11, to bring about a more uniform flake mat.

As a result of this mode of operation a flake mat 6 is produced which between the first and the second spreading roll 11, as seen from the right, always forms the bottom layer of the flake mat 6, while the 11th and 12th spreading rolls, likewise as seen from the right, form between them the uppermost layer of the flake mat 6 deposited on the preceding middle layers.

If now an additional spreading station 4 is disposed in a head at the head position, then, when the mat runs through this double spreading station, the result will be a complete flake mat, which is formed of the bottom layer, produced by the first and second spreading rolls, and obtains an upper cover layer which is applied by the two last spreading rolls 11, an additional set of spreading rolls 4, not shown, which is disposed in a mirror-image relationship to the spreading roll 4, downstream from the illustrated spreading station 4.

Figure 2:
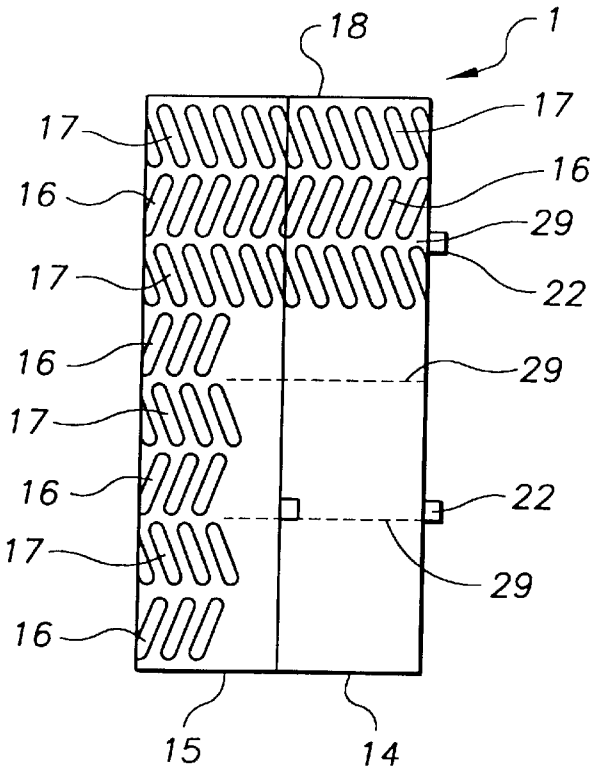
FIG. 2 represents spreading roll sleeves in development, with centering pins.

In FIG. 2 there is shown a development 13 of the circumference of spreading roll sleeves 14 and 15. As it can be seen from the developments 13, channel-like pockets 16 and 17 of equal length are provided on the circumference of the spreading roll sleeves 14 and 15 and form separate rows 18 over the length of the spreading roll sleeves, and each channel-like pocket 16 of the one half 18 forms with the axes 19 and 20 of each channel-like pocket 17 of the next row 18 an angle which in this embodiment is greater than 90 degrees with reference to the spreading roll axis 21 (cf. FIG. 4, for example).

The spreading roll sleeves 14 and 15 have a specific length and thus, by arranging together a plurality of such spreading roll sleeves 14 and 15, a spreading roll can be obtained in which the joining of the individual sleeves 14 and 15 is accomplished by means of positioning and locking pins 22 (see also FIG. 4, for example), so that journals 23 and 24 need only be provided on the two outermost spreading roll sleeves 14 and 15 (cf. FIG. 4), in order to mount the individual spreading roll consisting, for example, of spreading roll sleeves 14 and 15 in a bearing, not shown, within the spreading station 4. As in FIG. 1, all of the spreading rolls 11 can be disposed in a roll frame 25, therein represented. The roll frame 25 itself can be able to be raised and lowered (not shown) or inclined toward the support 5 (also not shown). By the raising and lowering and/or tilting of the roll frame 25 toward the support 5, the spreading distance between the plane of exit from the channel-like pockets 16 and 17 can be arranged in all stages at a given height, and also in relation to the slope of the mat above the mat under construction. As a result, no change of any kind takes place in the spreading of the channel-like pockets serving as holdout containers until reaching the support 5 or reaching the mat layer already in development.

If, while retaining the ability of the roll frame 25 to be raised and lowered and its ability to tilt, a greater distance 26 between the bottom end of the roll frame 25 and the continuously driven support 5 is selected, it will be possible within this distance to control the spreading process by means of a slight aspiration of air from the spreading chamber 4 or blowing of air into the spreading chamber 4. In this manner a deliberate separation is then created, which is brought about by the action of a flow of air.

Figure 3A:
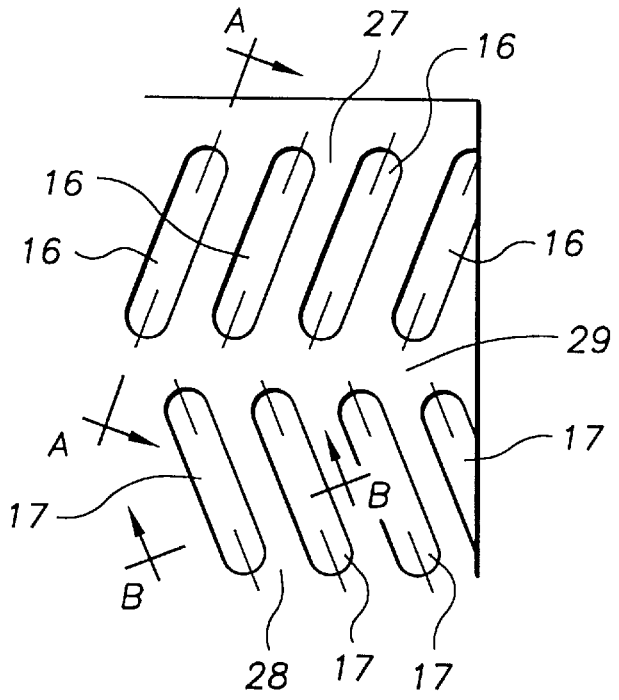
FIG. 3*a*) an enlarged view of the arrangement of the channel-like pockets according to the invention.

In FIG. 3*a* an enlarged portion of the development 13 shown in FIG. 2 has been selected to explain that, between the channel-like pockets 16 and 17, the lands 27 and 28 are provided, and also between the rows of channel-like pockets 16 and 17 lands 29 are provided, which run over the entire length of the spreading roll sleeves 14 and 15, respectively.

By means of the positioning and locking pins 22 it is brought about that the lands 29 run uninterrupted over the length of the entire spreading roll and thus form a termination of the channel-like pockets 16 and 17 in the direction of the flow of the particles; at the same time the locking and positioning pins 22 also bring about a smooth transition from one spreading roll sleeve to the next spreading roll sleeve.

Figure 3B:
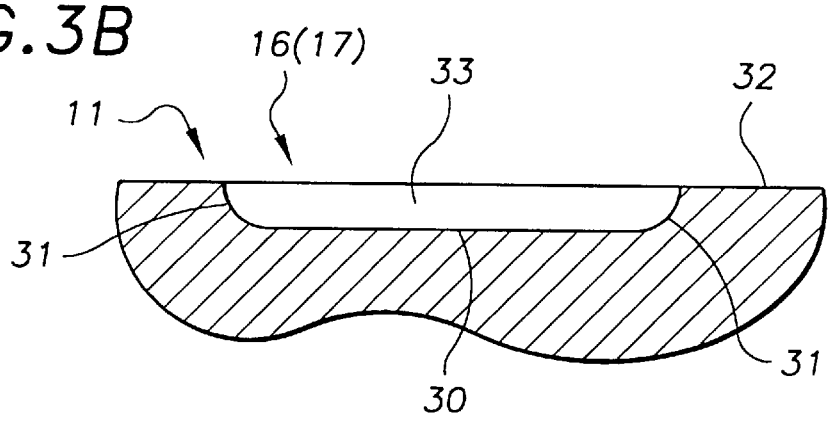
FIG. 3*b*) a section 3*b*—3*b* through FIG. 3*a*.

FIG. 3*b* shows a section taken along a channel-like pocket 16. As it can be seen therein, the ends of the channel bottom 30 curve semicircularly at 31 to the circumference 32 of the spreading roll 11.

Figure 3C:
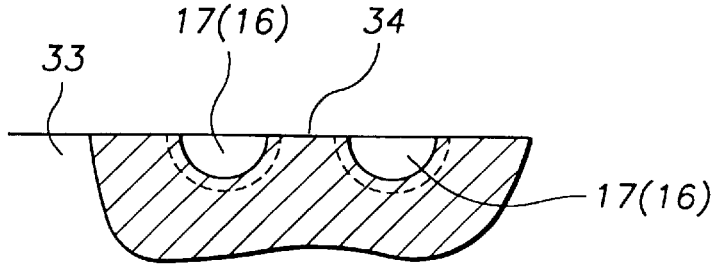
FIG. 3*c*) a section 3*c*—3*c* through FIG. 3*b*.

In FIG. 3*c*, which represents a section taken along line B—B in FIG. 3*a*, it can be seen that the channel-like pockets 16 and 17 are semicircular in shape, and that the channel bottom 30 is at a distance 33 from the periphery of the spreading roll 11. The channel bottom 30 is also at the same distance 33 from the periphery 32 of the spreading roll 11.

By machining operations or injection molding or pressure casting methods it is possible to vary the distance 33 between the periphery 32 of the individual spreading roll and the channel bottom 30. Thus the capacity of each channel-like pocket can be increased. This enlargement of capacity can also be achieved by reducing the widths 27 and 28 of the spaces and of the lands 29, so that between the channel-like pockets 16 and 17 there will remain only cutting edges 34 as in FIG. 3c on the surface 32 of the spreading roll 11. The same applies to the cutting edges then resulting between the channel-like pockets 16 and 17.

If the spreading rolls 11 are equipped with channel-like pockets widening downstream, it can easily be recognized that a substantially greater throughput of particles will be able to pass through the adjoining spreading rolls without the possibility of jamming as the particles pass through the spreading rolls 11. The largest channel-like pocket is in this case made always smaller than the particles which are not deposited and are discharged through the screw conveyor 12. Such sizing can be accomplished by the fact that, due to the smooth circumferential surface of all spreading rolls 11, it is possible to establish the size of the largest particle to be let through.

Figure 5:
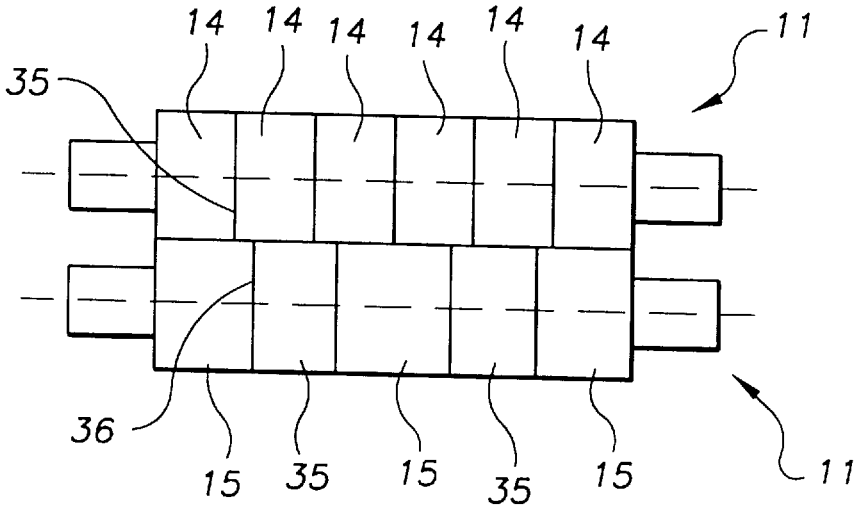
FIG. 5) a spreading roll consisting of a plurality of sleeves according to the invention, in cooperation with a second spreading roll also consisting of several sleeves.

In FIG. 5 two spreading rolls 11 are shown arranged side by side, in which the one spreading roll consists of spreading roll sleeves 14, while the other spreading roll 11 consists of spreading roll sleeves 15 and additional spreading roll sleeves 35. As the drawing indicates, the spreading rolls 11 lie close together, and the abutting edges 35 and 36 are offset from one another over the length of the spreading rolls 11. This prevents spreading errors from being created by these abutting edges. Instead of the abutting edges 35 and 36 spiral abutting edges can also be used between the individual spreading roll sleeves 14, 15, 35.

Figure 4:
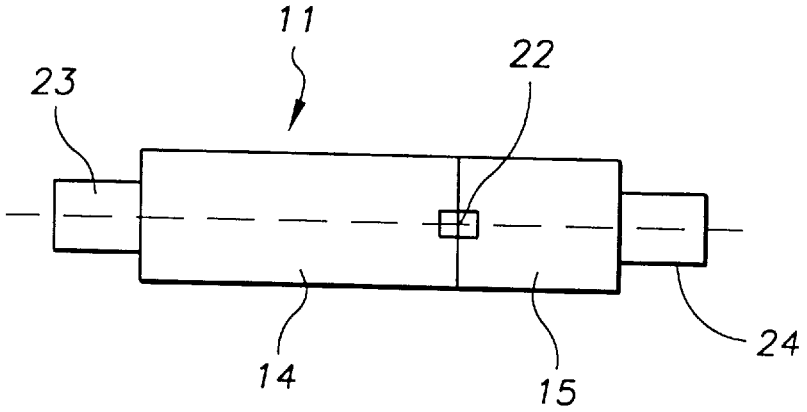
FIG. 4) a spreading roll composed of two sleeves of the invention.

As it is furthermore indicated in FIG. 4, when two spreading roll sleeves 14 and 15 are used, the abutting edges of these two sleeves are disposed off-center. Such a combination of spreading rolls 14 and 15 of different length to produce a single spreading roll 11 will be able to reduce the flexure of a spreading roll that does not consist of spreading roll sleeves.

If the distance 33 between the pocket bottom 30 and the circumferential surface 32 varies not in the direction of the feed of the spreading rolls but along the length of each individual roll, e.g., from the middle of the roll toward both its extremities, such that the distance 33 is greatest at the ends of each roll, the result will be a mat 6 which will have a convex build-up in the unpressed state. By the pressing of this convex mat a wood material board will be obtained which has an increased strength at its margins. As already explained, this can be used to advantage when such boards are to be joined together directly by means of splines and grooves.

We claim:

1. Method for the continuous production of an uninterrupted mat of stocked particles of different dimensions comprising spreading said particles by means of a conveyor spreading mechanism for a production of boards of wood material and subsequent pressing of the mat, wherein during the spreading process, channel-like pockets are first deliberately and continuously formed over the entire spreading width and the spreading length of the spreading mechanism, out of which individual distributing is done for the continuous formation of the mat as said mat advances.

2. Method according to claim 1, wherein the deliberate formation of the channel-like pockets is controllable over the spreading length of the conveyor spreading mechanism.

3. Method according to claim 1, wherein the deliberate formation of the channel-like pockets is controllable over the spread width of the conveyor spreading mechanism.

4. Method according to claim 1, wherein particles unsuited for the conveyor spreading mechanism are discharged by means of a conveyor mechanism separate from the conveyor spreading mechanism.

5. Method according to claim 4, wherein the discharged particles are fed to a regrinding mechanism at the end of which usable particles are returned to the conveyor spreading mechanism and unusable particles are separated.

6. Method according to claim 1, wherein a preselectable separation of the particles takes place dependent upon particles intended for the spreading and dependent upon the formation of the advancing mat by means of said conveyor spreading mechanism.

7. Apparatus for the continuous production of an uninterrupted mat of stacked particles of different dimensions comprising: a bunker for particles with an outlet, a spreading station adjoiningit, having a width that corresponds to a mat width to be produced, with a series of revolving spreading rolls disposed in the spreading station, the peripheries of said rolls bearing a pattern, and a support continuously moving under the spreading station for receiving a spread chip mat which then is pressed for the preparation of boards of wood material, wherein the circumferential surface of each spreading roll bears a plurality of rows, alternating in the circumferential direction, of first channel-like pockets of equal length, and offset therefrom a plurality of rows with second channel-like pockets of equal length, that each row of the channel-like pockets is separated on the circumferential surface from the next row by lands, and that the first and second equally long channel-like pockets are separated by lands over the entire length of the circumferential surface of the spreading roll, so that each channel-like pocket constitutes a separate pocket in the circumferential surface.

8. Apparatus accordingly to claim 7, wherein each spreading roll bears first equally long channel-like pockets disposed at an angle to its axis, that offset therefrom a plurality of rows with second equally long channel-like pockets are provided whose channel axes assume an angle to the angled channel axes of the first equally long channel-like pockets.

9. Apparatus according to claim 7, wherein the angle between the first and the second equally long channel-like pockets is greater than 0 degrees and less than 180 degrees.

10. Apparatus according to claim 7, wherein the channel-like pockets bear semicircular curves at their extremities on the roll periphery.

11. Apparatus according to claim 7, wherein the channel-like pockets are rounded from the roll circumference to the channel bottom, perpendicular to the direction of the channel axis.

12. Apparatus according to claim 11, wherein the distance (the depth) between the spreading roll circumferential surface and the channel bottom of the channel-like pockets has a different dimension from spreading roll to spreading roll.

13. Apparatus according to claim 7, wherein the channel-like pockets bear rounded cross sections.

14. Apparatus according to claim 7, wherein each spreading roll consists of at least two roll sleeves with equally long, channel-like pockets disposed in tandem on the axial direction, and that the lands have a continuous course without interruption over the entire circumferential length of the spreading roll.

15. Apparatus according to claim 14, wherein in the case of at least two spreading rolls in tandem, the visible circumferential abutting edges between the sleeves are out of alignment with one another.

16. Apparatus according to claims 14, wherein visible abutting edges occurring between the sleeves extend spirally over the circumferential surface of the individual spreading roll.

17. Apparatus according to claim 14, wherein in the case of two sleeves an abutting edge occurring between the spreading sleeves is disposed outside of the center between the two spreading roll end faces.

18. Apparatus according to claim 7, wherein the distance between the spreading roll circumferential surface and channel bottom of the channel-like pockets and the length of the individual spreading roll has a different dimension.

19. Apparatus according to claim 7, wherein the uninterrupted lands terminate in cutting edges at the spreading roll's circumferential surface.

* * * * *

UNITED STATES PATENT AND TRADEMARK OFFICE

CERTIFICATE OF CORRECTION

PATENT NO. : 5,887,515
DATED : March 30, 1999
INVENTOR(S) : Kunstmann et al.

It is certified that error appears in the above-identified patent and that said Letters Patent is hereby corrected as shown below:

Column 4,
Line 29, delete "of".
Line 49, delete the second phrase "length of the" before the word "individual".
Line 50, delete "arr" and in its place insert -- arrangement of the greater capacity --.
Line 57, substitute the word "invention" for the word "apparatus".

Column 8,
Line 67, insert a space between the words "adjoining" and "it" to read as
-- adjoining it --.

Signed and Sealed this

Twenty-fourth Day of July, 2001

Nicholas P. Godici

*Attest:*

*Attesting Officer*

NICHOLAS P. GODICI
*Acting Director of the United States Patent and Trademark Office*